United States Patent [19]

Niklas

[11] 4,095,136

[45] June 13, 1978

[54] IMAGE TUBE EMPLOYING A MICROCHANNEL ELECTRON MULTIPLIER

[75] Inventor: Wilfrid F. Niklas, Portola Valley, Calif.

[73] Assignee: Varian Associates, Inc., Palo Alto, Calif.

[21] Appl. No.: 194,765

[22] Filed: Oct. 28, 1971

[51] Int. Cl.[2] ..... H01J 31/48

[52] U.S. Cl. ..... 315/11; 250/213 VT; 313/105 CM

[58] Field of Search ..... 315/11, 12; 313/68 A, 313/103, 104, 105; 250/213 VT

[56] References Cited

U.S. PATENT DOCUMENTS

| | | | |
|---|---|---|---|
| 3,086,139 | 4/1963 | Lehrer | 315/12 |
| 3,339,099 | 8/1967 | Anderson | 313/68 A |
| 3,634,712 | 1/1972 | Orthuber | 313/105 X |
| 3,660,668 | 5/1972 | Wolski | 250/213 VT |
| 3,673,457 | 6/1972 | Sackinger et al. | 315/12 |

*Primary Examiner*—Peter A. Nelson

*Attorney, Agent, or Firm*—Edward J. Radlo; Stanley Z. Cole

[57] ABSTRACT

In an image tube, a microchannel electron multiplier plate is disposed between the photocathode and a cathodoluminescent output screen for multiplying the electron current of electron images. Electrodes are deposited upon the input and output face of the microchannel electron multiplier plate. On the output face the electrode is deposited into the ends of the microchannels to a distance of approximately 2 diameters of the individual channels. A semiconductive material, such as zinc sulphide, is deposited over the output electrode in the output ends of the microchannels for causing the secondary electrons emitted from the end portions of the microchannels to show a narrow energy spread, whereby the resolution of the intensified output image is enhanced.

3 Claims, 4 Drawing Figures

IMAGE TUBE EMPLOYING A MICROCHANNEL ELECTRON MULTIPLIER

GOVERNMENT CONTRACT

The invention herein described was made in the course of or under a contract or subcontract thereunder with the Department of Defense.

DESCRIPTION OF THE PRIOR ART

Heretofore, microchannel electron multiplier plates have been employed in image tubes for multiplying the electron current of the electron image. An example of such an image tube is disclosed in an article titled "Channel Multiplier Plates For Imaging Applications," appearing in the Mullard Technical Communications Journal in an article by A. Guest et al, reprints of which are available from Mullard Ltd. of London as technical publication No. 1065 (1968), pages 2–7.

In these prior electron multiplier plates, metallic electrodes were deposited over input and output faces thereof with the output electrode extending into the output ends of the channels for a distance of approximately 2 channel diameters. Extending the metallic electrode into the output ends of the channels served to enhance the focusing effect of the electron lenses, formed at the channel exits, such that the electrons were better collimated as they emerged from the individual channels. In addition, extending the metallic electrodes into the ends of the channels provided increased contact area for making electrical contact to the resistive walls of the individual channels for applying the required accelerating potential throughout the channelized plate. This is especially important in the case where the wall thickness between the channels is reduced to an absolute minimum to provide increased effective area of the multiplier plate. In a typical example, the individual channels have a length to diameter ratio of approximately 30 to 40 with channel diameters on the order of 17 microns and minimum wall thicknesses between adjacent channels of approximately 2 microns.

One of the problems with the prior art microchannel electron multiplier plate is that the electron bundles projected from the individual channels in the microchannel plate toward the phosphor output screen suffer in general from wide aberration shoulders in the cross section density distribution of each of the electron bundles. These wide aberration shoulders appear regardless of the mode of electron optical focusing at the entrance of the microchannel plate. The wide aberration shoulders are due to the angular energy distribution of the electrons emitted from the channels of the microchannel plates. The energy distribution is in-turn co-affected by the nature of the evaporated metal contact penetrating into the output ends of the channels in the microchannel plate.

Wide aberration shoulders, while not only influencing the limiting resolution, expressed in terms of a minimum perceptible output contrast for 100% input contrast at high spatial frequencies, i.e., 25–30 line pairs/mm, deteriorates markedly the contrast transfer function at lower spacial frequencies, i.e., 5–20 line pairs/mm. As the contrast transfer for 100% input contrast at low spatial frequencies is equivalent to contrast transfer for low input contrast at high spatial frequencies, the aforementioned wide aberration shoulders seriously impair information transfer achievable at low input contrast values as are typically obtained under practical night observation conditions. Thus, it is desired to reduce the wide aberration shoulders in the electron bundles as focused from the microchannel multiplier onto the cathodoluminescent output screen.

SUMMARY OF THE PRESENT INVENTION

The principal object of the present invention is the provision of an improved image tube employing a microchannel electron multiplier.

In one feature of the present invention, the electrode portions which extend into the output ends of the channels of the microchannel electron multiplier are coated with a semiconductive material for causing the secondary electrons emitted from the output ends of the channels to have a narrower energy spread, thereby reducing the wide aberration shoulders of the electron bundles as focused onto the output screen for improving the information transfer at low input contrast values to the microchannel plate.

In another feature of the present invention, the semiconductive layer which is deposited over the output electrode comprises zinc sulfide.

In another feature of the present invention the semiconductive layer, which is deposited overlaying the output metallic electrode of the microchannel plate, extends into the output ends of the channels by an extent falling within the range of 1 to 4 channel diameters.

Other features and advantages of the present invention will become apparent on a perusal of the following specification taken in connection with the accompanying drawings wherein:

DESCRIPTION OF THE PREFERRED EMBODIMENTS

Figure 1:
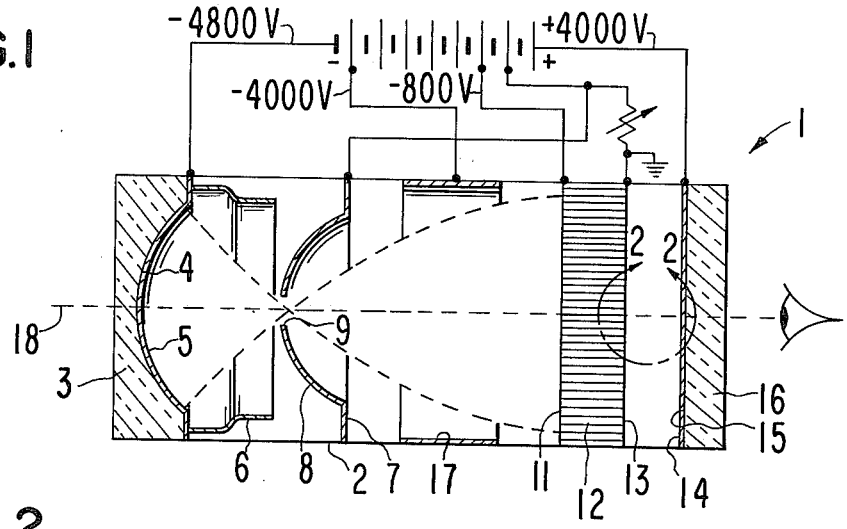
FIG. 1 is a schematic longitudinal sectional view depicting an image tube incorporating features of the present invention.

Referring now to FIG. 1, there is shown an image tube 1 incorporating features of the present invention. Image tube 1 includes a tubular evacuated envelope 2, as of glass or ceramic, closed at the input end thereof via an optically transparent input plate 3, as of glass. The inside face of input plate 3 has a spherically concave surface 4 over which may be deposited an optically transparent electrode, as evaporated gold. A photocathode material 5 is deposited over the electrode 4. A cylindrical focus electrode 6 is electrically connected to the transparent electrode 4 and photocathode 5 and projects inwardly of the tube. A centrally apertured anode electrode 7 is disposed adjacent the photocathode 5 and includes a spherically convex face 8 disposed facing the spherically concave photocathode 5. The radius of curvature of the convex face 8 is preferably within 40 to 100% of the radius of curvature of the photocathode 5.

The anode 7 serves to accelerate and focus the electron image emitted into the tube 2 from the photocathode 5 through the central aperture 9 of the anode and onto the input face 11 of a microchannel electron multiplier plate 12. The microchannel electron multiplier plate 12 includes a multitude of closely packed channels, as of 17 microns in diameter and having a length to diameter ratio of between 30 and 40. A pair of metal electrodes are deposited over the input and output faces 11 and 13, respectively, of the multiplier plate 12. The minimum wall thickness between adjacent channels in the plate 12 is approximately 2 microns.

The input and output electrodes are deposited into the input and output ends of the channels to an axial extent of approximately 2 channel diameters to assure good electrical contact to the resistive glass walls of the channels. The electron current flowing through the resistive walls of the channels from the input end to the output end produces a gradient or electric field extending axially of the individual channels for accelerating secondary electrons and for directing the output electron current of the multiplier axially of channels to a cathodoluminescent output screen 14 deposited upon the inside face 15 of an output optically transparent plate 16, as of glass, sealed over the output end of the evacuated tube 2.

An electron permeable electrode, as of aluminum film, is deposited over the inside face of the cathodoluminescent screen 14 for equalizing a potential of the screen 14 and to increase the light output due to reflection. An electron accelerating potential is applied between the output face 13 of the electron multiplier plate 12 and the output screen 14 for focusing the output electron bundles of the electron multiplier plate 12 onto the screen 14. The electrons incident upon the phosphor screen 14 convert the electron images into photon images which are then either observed or picked up by suitable utilization device, such as a TV camera tube or the like.

A hollow cylindrical distortion corrector electrode 17 is disposed on the inside wall of the tube 2 between the anode 7 and the input face 11 of the electron multiplier plate 12 for causing the electron image trajectories to intercept the input face 11 of the electron multiplier plate 12 at approximately normal angles to the plane of the input face 11. The individual channels of the multiplier plate 12 are canted at a slight angle, as of 7°, to the optical axis 18 of the tube such that the input electrons will be incident on the side walls of the channels of the microchannel plate to produce secondary electron emission close to the input end so that cascaded secondary electron emission is stimulated as the secondary electrons collide with the opposing walls to produce multiplication of the electron image at the output end of the multiplier plate 13.

Typical operating potentials are indicated in FIG. 1. More particularly the photocathode 5 is operated at a potential, as of −4800 volts relative to the output face 13 of the microchannel plate. The anode 7 is operated at essentially ground potential which is the potential of the output face 13 of the microchannel plate 12. The distortion corrector electrode 17 is operated at a potential as of −4000 volts relative to the output of the microchannel plate 13. The input face 11 of the microchannel plate is operated at −800 volts relative to the output face 13 of the microchannel plate 12. The output fluorescent screen 14 is operated at a potential as of +4000 volts relative to the output face of the microchannel plate 13.

In operation, photon images to be intensified are received through the input face 3 and transparent electrode into the photocathode layer 5 wherein they are absorbed and converted from photons into electrons and emitted as a corresponding electron image into the image tube, accelerated and focused by the anode 7 onto the input face 11 of the microchannel plate 12, multiplied therein, and focused against the output screen 14 to provide a greatly intensified photon image of the input image. Typical gains for the microchannel plate 12 are on the order of 5,000 to 10,000.

Figure 2:
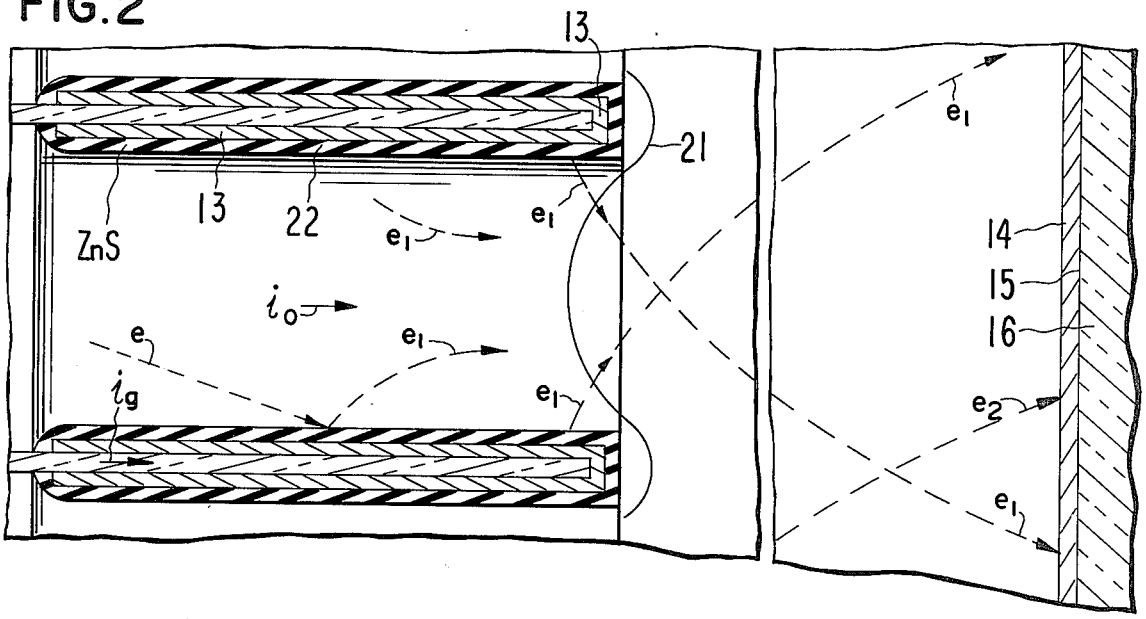
FIG. 2 is an enlarged fragmentary sectional view of a portion of the structure of FIG. 1 delineated by a line 2—2.

Referring now to FIG. 2, there is shown the output end of a channel in the microchannel plate 12 and the adjacent fluorescent screen 14. Generally speaking, the spacing from the output face 13 of the microchannel plate 12 to the fluorescent output screen 14 is on the order of the same length as the length of the channels within the microchannel plate 12, i.e., 30 to 40 channel diameters. The output electrode 13, as of inconel metal, is deposited over the output ends of the channels in the microchannel plate to an axial extent of approximately 2 channel diameters.

At the open end of each of the channels the equipotential lines at 21 dip into the channel, thereby forming an electrostatic lens. This electrostatic lens tends to focus divergent electrons passing therethrough onto the output screen 14. However, if the electrons emitted from the inside bore of the channel near the end of the channel have widely differing energies these widely differing energies will be focused at substantially different radii on the screen 14, thereby obtaining undesired wide aberration shoulders. Secondary electrons emitted from a metallic surface are known to include a large portion of elastically scattered electrons of higher energies, thus producing substantially different focal radii and tending to produce wide aberration shoulders in the electron bundles as focused onto the output screen 14. Therefore, in the present invention the output electrode 13, particularly that portion thereof extending into the ends of the channels of the channel plate 12, is covered with a thin layer 22 of semiconductive material such as zinc sulfide, cadmium sulfide, evaporated germanium, and others which are known to produce fewer elastically scattered electrons, the emitted secondary electrons being concentrated near lower energies. Thus, the secondary electrons as emitted from the semiconductive layer 22 are more nearly monoenergetic as compared to those electrons previously emitted from the metallic end electrode 13 for reducing the wide aberration shoulders of the electron bundles as focused by the output lens 21 on the output screen 14.

The semiconductive layer 22 is conveniently formed by evaporation of the conventional P-11 phosphor commercially available from RCA and comprising essentially zinc sulfide. This is a particularly suitable semiconductive material because it is stable under high vacuum conditions and provides the desired concentration of the secondary electrons in the low energy region. The semiconductive layer is deposited to a thickness of several angstroms and is conveniently formed to the desired thickness by monitoring the thickness of the evaporated layer on a glass plate (not shown) while wobbulating the microchannel plate in the conventional manner to cause the evaporated material to be deposited to an equal depth of approximately 2 channel diameters into the ends of the channels in the microchannel plate. The transmission through the glass plate, disposed to receive the evaporated material, is monitored and evaporation is ceased when the transparency through the glass plate has been reduced to approximately 85% of its original value.

Figure 3:
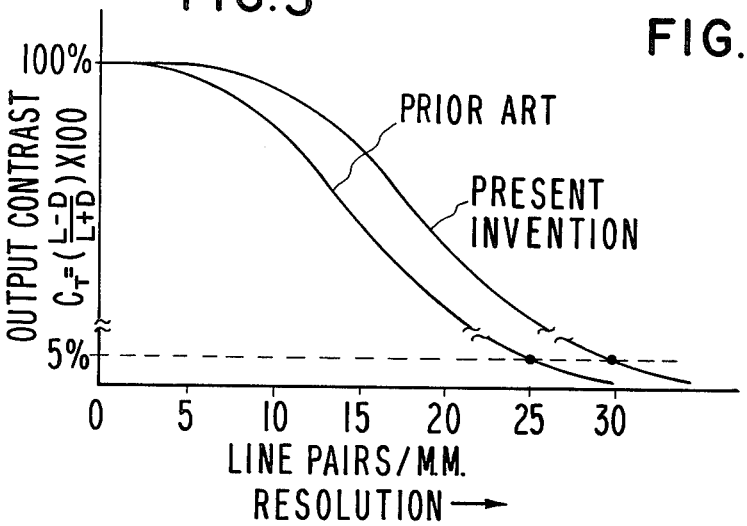
FIG. 3 is a plot of output transfer versus resolution in line pairs per millimeter for 100% input contrast for the prior art tube and for the tube of the present invention.
Figure 4:
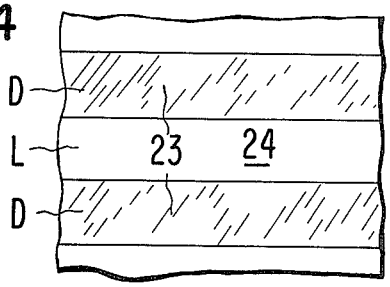
FIG. 4 is a schematic diagram depicting a line pair.

Referring now to FIGS. 3 and 4 the improved results of the use of the semiconductive layer 22 over the output electrode 13 of the microchannel plate 12 are observed. More particularly, FIG. 3 shows a plot of output contrast for 100% input contrast versus resolution in line pairs per millimeter and FIG. 4 shows a line pair at 23 and 24. More particularly, there is a dark line 23 and a light line 24 of equal width, there being a certain number of such line pairs per millimeter. Output contrast $C_T$ is defined according to the equation shown on the ordinate of FIG. 3. More particularly, output contrast in percent is defined as the brightness of the light line L less the brightness of the dark line D over the brightness of the light line L plus the brightness of the dark line D times 100. Due to the wide aberration shoulders of the prior art tube the highest number of line pairs per millimeter detectable by the eye at 5% output contrast $C_T$ was 25, (also known as the high spatial frequency cutoff) whereas utilizing the semiconductive layer 22, which reduced the aberration shoulders, permitted resolution at 5% output contrast of 30 line pairs per millimeter, thereby increasing the performance (high spatial frequency cutoff) of the image intensifier tube 1 at high input contrast levels. Also important, however, is the increase in output contrast $C_T$ in the resolution range of 5 to 20 line pairs/min. Over this lower range of spatial frequency resolution the output contrast $C_T$ is improved by for example 25–30%, thereby greatly increasing the transfer of information at low input light contrast as typically obtained under normal night lighting conditions.

What is claimed is:

1. In an image tube, means for producing an electron image in the tube, a multichannel electron multiplier means having an electron image input face and an output face, means for accelerating and for directing said electron image upon the input face of said multichannel electron multiplier means for multiplying the electron current of said received image, an output means spaced from said output face of said electron multiplier means for receiving the multiplied output electron image of said electron multiplier means, metallic electrode means formed on the output face of said multichannel electron multiplier means for applying an operating potential to said output face of said electron multiplier means, said electrode means extending into the output ends of the channels and over the inside walls of said channels in said multichannel electron multiplier means, and a layer of semiconductive material overlaying said metallic electrode means, said semiconductive layer extending over said electrode means and into an output end portion of said channels, the remaining portion of said channels being free of said semiconductive material, for improving the information transfer of the electron image as directed from the output face of said multichannel electron multiplier onto said output means.

2. The apparatus of claim 1 wherein said semiconductive material is zinc sulfide.

3. The apparatus of claim 1 wherein said electrode means and said overlaying semiconductive layer extend into the output ends of said channels for an axially extent within the range of 1 to 4 channel diameters.

* * * * *